United States Patent [19]

Harvey

[11] Patent Number: 5,058,258

[45] Date of Patent: Oct. 22, 1991

[54] RETROFIT ELECTRIC TRUCK DOOR LOCK

[76] Inventor: Steve M. Harvey, 4548 Gilbert Ave., Corona, Calif. 91719

[21] Appl. No.: 480,820

[22] Filed: Feb. 16, 1990

[51] Int. Cl.[5] ..... E05B 47/06

[52] U.S. Cl. ..... 29/401.1; 29/402.08; 70/257; 70/279; 70/462; 292/201

[58] Field of Search ..... 70/462, 256, 257, 279; 292/201, 244; 29/401.1, 402.03, 402.08

[56] References Cited

U.S. PATENT DOCUMENTS

| | | | |
|---|---|---|---|
| 2,885,239 | 5/1959 | Young, Jr. et al. | 292/201 |
| 3,016,968 | 1/1962 | Lenz et al. | 292/201 X |
| 3,347,584 | 10/1967 | Johnstone | 292/210 X |
| 3,504,511 | 4/1970 | Allen | 70/241 |
| 3,933,382 | 1/1976 | Counts et al. | 292/144 |
| 4,322,959 | 4/1982 | Mochida | 70/279 X |
| 4,370,874 | 2/1983 | Munn | 292/210 X |
| 4,669,283 | 6/1987 | Ingenhoven | 70/264 |
| 4,866,963 | 9/1989 | Leininger et al. | 70/278 |
| 4,876,783 | 10/1989 | Campion et al. | 29/402.03 X |

FOREIGN PATENT DOCUMENTS

| | | | |
|---|---|---|---|
| 116683 | 3/1943 | Australia | 292/201 |
| 2241986 | 3/1975 | France | 70/462 |
| 2142078 | 1/1985 | United Kingdom | 292/201 |

*Primary Examiner*—Lloyd A. Gall

*Attorney, Agent, or Firm*—Timothy T. Tyson

[57] ABSTRACT

An apparatus and method are described, for converting vehicle door locks that can be only manually operated, into door locks that can be either electrically or manually opened and closed. The door lock originally has a key-operated lock device with a key cylinder projecting to the outside and with a lock member that can be moved to prevent rotation of a latch (22, FIG. 5) to its open position to enable opening of the door. The original door lock device is removed and a power pack (60) is installed, which includes a mechanism (64) that can engage the door latch, with the mechanism being operated by either an electrically energized action motor (70) or a key operated lock device (40A). The key operated lock device on the power pack has a cylinder (84) that mounts in the same position as the key cylinder of the original lock device that was removed.

1 Claim, 3 Drawing Sheets

FIG. 6
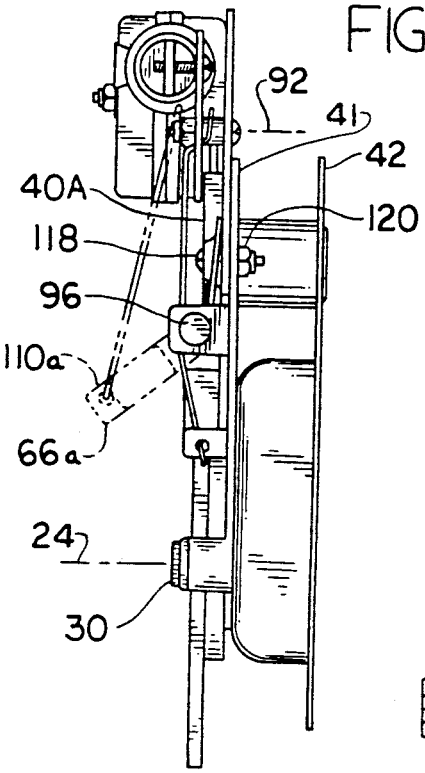
FIG. 7
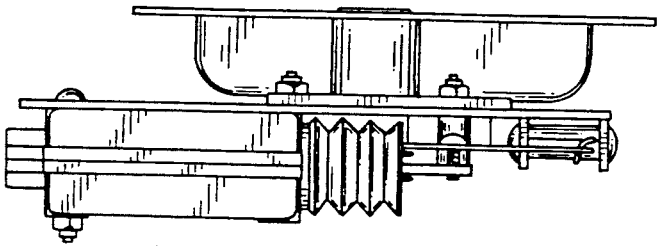
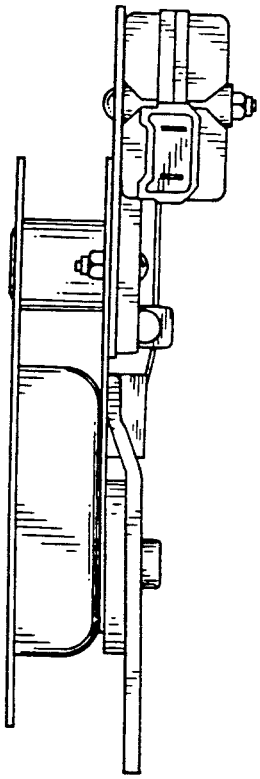
FIG. 8

RETROFIT ELECTRIC TRUCK DOOR LOCK

BACKGROUND OF THE INVENTION

Utility trucks may have many compartments spaced around the truck, with each compartment having its own outside door and its own key-operated door lock. When a worker drives the truck to a worksite, he may have to go around the truck and use a key to unlock perhaps six doors to enable ready access to all equipment. When the worker leaves the truck to go to lunch, a restroom, or another site, he must go around the truck and use his key to lock all six doors, and later unlock them. A single control in the truck cab which locks and unlocks all access doors makes truck usage more convenient, and such an electrically-operated lock system can be installed at the factory. However, it can be expensive to retrofit existing trucks, largely because it can be difficult to install new lock mechanisms that can be electrically or key-operated, in place of the existing key-operated lock device. A method and apparatus which enabled a low cost conversion of each door lock to one which was both electrically and key operated, would be of considerable value.

SUMMARY OF THE INVENTION

In accordance with one embodiment of the present invention, a door latch-operating power pack and installment method is provided, which facilitates conversion of a solely key-operated door lock to one which is alternately remotely electrically operated or key operated. The original key-operated lock device is removed and a power pack is installed on the door lock frame. The power pack includes a mechanism that is operable to a closed position wherein it engages the closed door latch to prevent it from moving to an open position, the mechanism also being operable to an open condition wherein it does not prevent moving the door latch to the open position. The power pack also includes an electrically energized action motor that can move the mechanism, and a key-operated lock device which also can move the mechanism. The key-operated lock device on the power pack has a key cylinder which mounts in the same cylinder-receiving holes of the door frame that originally held the key cylinder of the now-removed lock device.

The original key-operated lock device which was removed, can be installed on the power pack, in a 180° rotated position, to avoid the need for a separate lock device. The mechanism of the power pack which can engage the door latch, can include a pivot arm pivotally mounted on the power frame about a perpendicular axis and a locking tab which pivots about an axis parallel to a surface of the power frame and which is coupled by a link to the pivot arm.

The novel features of the invention are set forth with particularity in the appended claims. The invention will be best understood from the following description when read in conjunction with the accompanying drawings.

BRIEF DESCRIPTION OF THE DRAWINGS

FIG. 6 is a right side view of the assembly of FIG. 5.

FIG. 7 is a top view of the assembly of FIG. 5.

FIG. 8 is a bottom view of the assembly of FIG. 5.

DESCRIPTION OF THE PREFERRED EMBODIMENT

Figure 1:
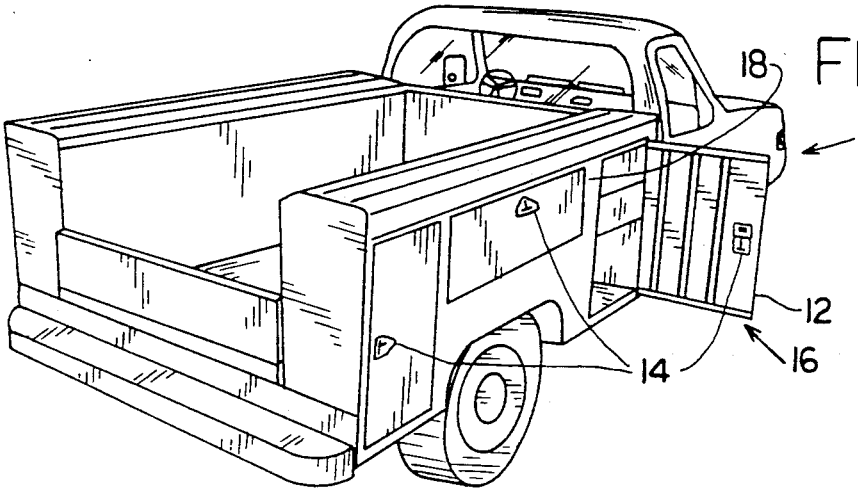
FIG. 1 is a perspective view of a utility truck, showing the positions of a few door locks thereof.
Figure 2:
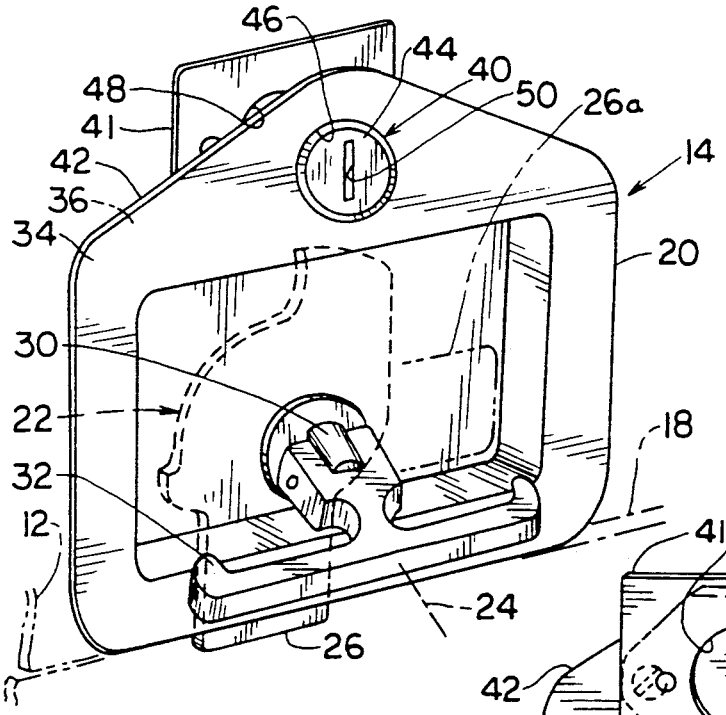
FIG. 2 PRIOR ART
FIG. 2 is an isometric front view of a door lock of FIG. 1, with the original key-operated lock device in place.

FIG. 1 illustrates a utility truck 10 which includes at least six compartments having differently shaped doors 12 but substantially identical door locks 14. Each door 12 is part of a door device 16 that includes a door frame 18. As shown in FIG. 2, each door lock 14 includes a lock frame 20 mounted on one of the door parts (door 12 or door frame 18) such as the door 12. A latch 22 is pivotally mounted on the lock frame about a latch axis 24. In the closed position of the latch, its latching part 26 lies in interference with the door frame to prevent opening of the door. In the open position, the latch part lies at the position **26*a* to permit opening of the door. The latch is pivotally mounted on a shaft 30 which holds a handle 32 accessible from the outer side 34 of the lock frame. The inner side 36 of the lock frame is hidden when the door is closed. An original key-operated lock device is mounted to mount portions 41, 42 of the lock frame. The lock device 40 has a key cylinder 44 that projects through cylinder-receiving holes 46, 48 in the frame so that a keyhole 50** of the lock cylinder is accessible from the outer side of the lock frame.

Figure 3:
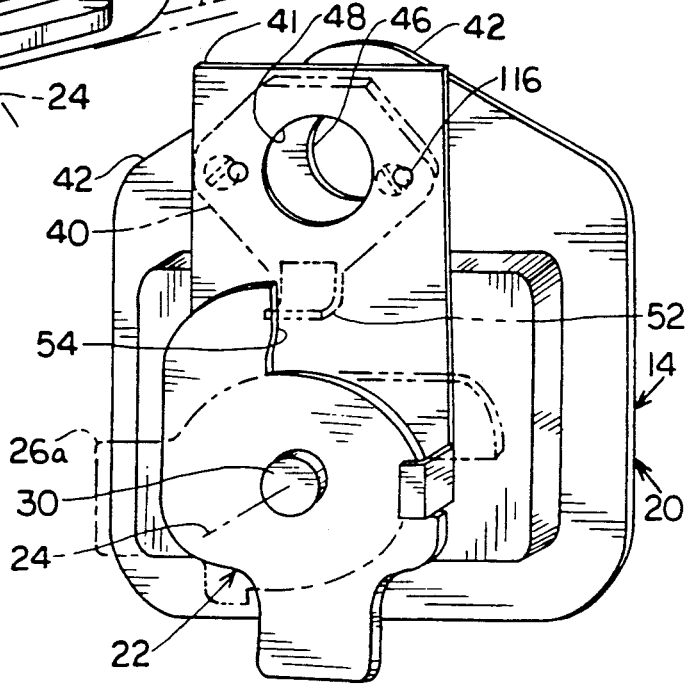
FIG. 3 PRIOR ART
FIG. 3 is an isometric rear view of the door lock of FIG. 2, with the original lock device shown in phantom lines and read receive a power pack.

As shown in FIG. 3, the original key-operated lock device 40 has a locking member 52 which can project down into the path of a latch shoulder 54 to keep the door lock closed. When a key is turned, the locking member 52 is withdrawn upwardly. It would be highly desirable if the door lock 14 could be altered at low cost so that the latch 22 could be moved between its open and closed positions by either key operation of a key-operated lock device, or remotely through electrical energization of the door lock. Such remote electrical energization and control, would allow a person in the cab of the truck, to lock or unlock all door locks (when their latches are in the closed position) by merely operating one switch in the cab of the truck. It is noted that a worker turns the door lock handle (and therefore the latch) to a closed position whenever he closes the door.

Figure 4:
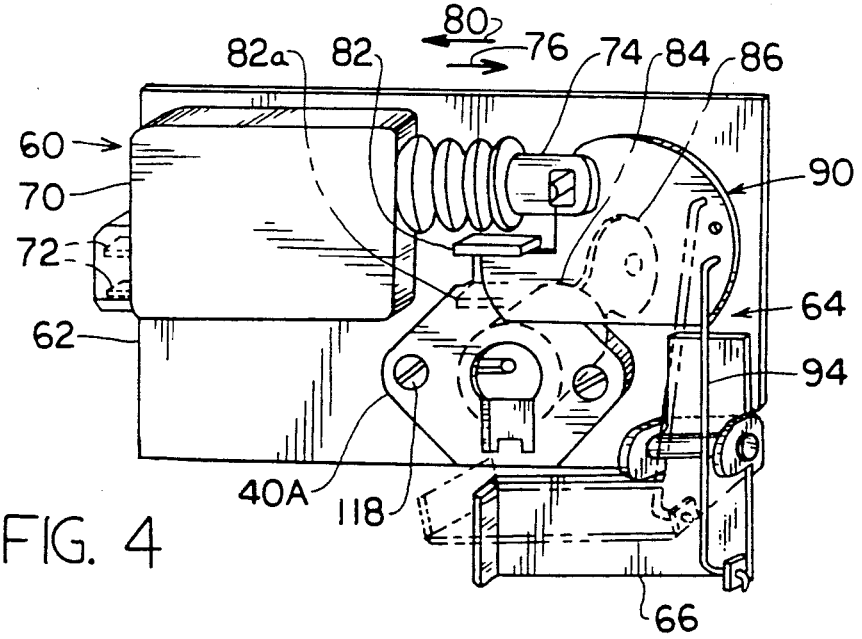
FIG. 4 is an isometric view of a power pack which can mount on the door lock of FIG. 3.

FIG. 4 illustrates a power pack 60 which can be mounted on the lock frame 20 to enable both key and remote electrical control of the door lock. The power pack includes a power frame 62 that mounts on the lock frame 20 and which has a latch-engaging mechanism 64 with a locking tab 66 that can be positioned adjacent to the latch shoulder 54 (FIG. 3) to prevent turning of the latch to its open position. The power pack includes an action motor 70 which can be electrically energized through currents applied to electrical terminals 72 to extend or withdraw a piston 74 that is connected to the mechanism 64. When the piston 74 moves in a closed direction 76, it operates the mechanism 64 to move the locking tab 66 against the latch shoulder 54 (in the path of movement of the latch shoulder) to keep the lock closed. When the piston is moved in the open direction 80, it moves the mechanism 64 to withdraw the locking tab 66 to allow the latch to be turned to open the door.

The power pack also includes a power pack lock device 40A mounted on the power frame 62 and which is identical to the original lock device 40 of FIGS. 2 and 3. However, the power pack lock device 40A is turned 180° from its original orientation shown at 40 in FIG. 3. The lock device 40A (FIG. 4) has a power pack lock member 82, shown in its closed position, which can be moved down to the position 82*a* to operate the mechanism 64 so as to allow the door latch to be moved to the open position. The lock device 40A has a key cylinder 84 operated by a key 86, with the cylinder installed in the same holes 46, 48 (FIG. 3) as the original lock device that was removed, and with the key hole 50 (FIG. 2) of the cylinder accessible from the outer side 34 of the lock frame. The only difference is that the cylinder is upside down, so the key 86 has to be installed in an upside down position, which generally has no adverse effect.

Figure 5:
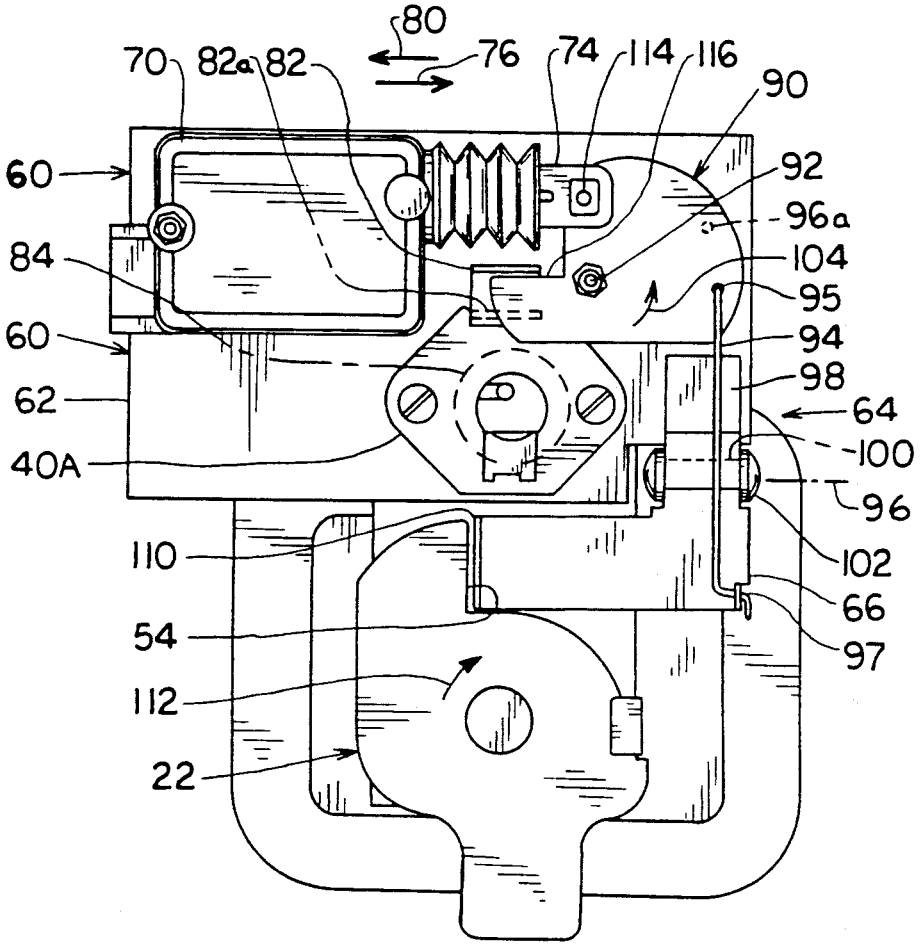
FIG. 5 is a rear elevation view of the power pack of FIG. 4, shown mounted on the door lock of FIG. 3, with the locking in a locked position.

As shown in FIG. 5, the mechanism 64 which can engage the door latch includes a pivot arm 90 that is pivotally mounted about an arm axis 92 on the lock frame 62. A link 94 extends from a location 95 on the pivot arm to a location 97 on the locking tab 66 to couple them. The locking tab 66 is pivotally mounted about a tab axis 96 on the power frame 62. In the particular construction shown, the power frame includes an extension portion 98 forming an axle at 100, and the locking tab has a pair of arms 102 pivotally mounted on the axle 100 about the axis 96. When the pivot arm 90 rotates in the opening direction indicated by arrow 104 so the upper end of the link moves to the position indicated at 96*a*, the lower end of the link raises the tab to the position shown in phantom lines in FIG. 6 at 66*a*. This raises a locking tab part 110 (FIG. 5) to the position 110*a* wherein it is clear of the latch shoulder 54. This allows the latch to be manually turned in the direction of arrow 112 to move the latch to the open position so the door can be opened. It is noted that most of the weight of the locking tab 66 hangs from the tab axis 96, so the locking tab 66 tends to fall to its locking position. A spring can be used to supplement the force of gravity to further urge the tab to the locking position.

The piston 74 of the action motor 70 receives a rod 114 of the pivot arm 90. As a result, when the action motor is energized to move the piston in the opening direction 80, the piston moves the pivot arm in the opening direction 104 to lift the locking tab. When the piston moves in the closing direction 76, it turns the pivot arm 90 in the opposite direction to lower the locking tab 66 so it can engage the latch shoulder 54.

The lock member 82 of the key-operated power pack lock device 40A has a flange that engages a shoulder 116 on the pivot arm 90. When the key of the lock device 40A is turned to move down the lock member 82 to the position 82*a*, the lock member rotates the pivot arm 90 in the opening direction 104, which causes the locking tab 66 to lift up to allow the latch to move to its open position. When the key of the lock device 40A is turned in the opposite direction, the locking member is raised to the position 82. In the particular construction shown, the locking member 82 does not force the pivot arm 90 in a closing direction opposite to the arrow 104, but the weight of the locking tab 66 plus the force of any spring tending to move it to its closed position will move the tab closed. It should be noted that the force of gravity on the locking tab 66 and the force of any spring tending to move the tab to its closed position, is sufficient to move the power motor piston 74 when the power motor is not energized.

As shown in FIG. 3, the particular lock frame 20 includes two plate-like portions 41, 42 that have aligned cylinder-receiving holes 46, 48. The rearward plate 41 also has a pair of screw-receiving holes 116. The lock device 40A (FIG. 4) has a pair of screws 118 that pass through the power frame 62 and through the holes 116 in the lock frame part 41 and which are held by nuts 120 (FIG. 6). The screws securely hold the power pack frame to the lock frame, while at the same time holding the key-operated lock device 40A in place, with its lock cylinder projecting through holes in the lock frame.

The original lock device 40 and the power pack lock device 40A of the power pack 60 are identical, but the power pack lock device 40A is installed in an upside down orientation (rotated 180°) from the original lock orientation. The original lock 40 which is removed, can be reinstalled on the power pack frame 62. This avoids the need for buying a separate lock, and the need to have the cylinder of the separate lock be of the same diameter as that of the original lock. Also, in many trucks the lock devices at the various doors can all be locked and unlocked with the same key, which may also operate other parts of the truck such as the ignition. Using the same locks that originally came with the truck avoids the need for finding locks whose keys are identical and which match the ignition lock or other lock of the truck. Of course, using the same locks also reduces the cost of the system. The ability to mount a new power pack on an existing lock frame makes installation very simple, because it avoids the need for installing a new door lock or drilling holes in the original door lock frame, as well as the advantages described above.

Thus, the invention provides an improvement to a door lock and a method therefor, which facilitates the retrofit of a power pack to an existing door lock, where the power pack allows both remote electrical operation as well as local key operation of the lock. The power pack includes a key-operated lock device with a cylinder that mounts in the same holes as the original lock device which has been removed from the door lock frame. An electrically energized action motor of the power pack, as well as a key operated lock device of the power pack operate a mechanism that can prevent or allow movement of the door latch to allow or prevent opening of the door lock. The mechanism can include a pivot arm that pivots about an axis normal to the power pack frame, and which is coupled by a link to a locking tab that pivots on the power pack frame about an axis that is perpendicular to the axis of the pivot arm. The same lock device that was originally present in a solely key-operated lock, can be used as the lock device on the power pack.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A method for converting a door lock of the type that has a door lock frame with an inside and an outside, a door latch mounted on the door lock frame to move between open and closed positions, a handle on the outside of the frame and coupled to the latch to manually move it, and an original key-operated lock device with an original key cylinder and a lock member that can prevent turning of the latch, wherein said lock frame has a key lock mount portion which holds said lock device and wherein said lock frame has a cylinder-receiving hole which holds said original lock key cylinder with a keyhole thereof accessible from the outside of the lock frame, wherein the method allows for remote electrical control of the door lock comprising:

removing said original lock device;

mounting a power frame on said door lock frame, wherein said power frame has a latch-engaging mechanism that is operable between a closed position wherein it prevents opening said door latch and an open position wherein it allows opening of said door latch, an electrically energizable action motor for operating said mechanism, and a key operated power pack lock device which can be key operated to operate said mechanism, wherein said power pack lock device has a key cylinder with a keyhole;

said mounting a power frame including projecting said key cylinder of said power pack lock device through said cylinder-receiving hole, with the keyhole accessible from the outside of said door lock frame;

installing a lock device on said power frame to serve as said key operated power pack lock device, by using a lock which is substantially identical to said original lock which was removed, with said lock being installed in an orientation wherein it is rotated about an axis of said original lock cylinder from the position of the original lock device, whereby to enable use of a lock removed from the same or a similar door lock.

* * * * *